US010568797B1

(12) United States Patent
Janzen

(10) Patent No.: US 10,568,797 B1
(45) Date of Patent: Feb. 25, 2020

(54) SPINAL CORD AND MENINGES STRETCHING FRAME AND METHOD TO PREVENT AND TREAT THE ROOT CAUSE OF SCOLIOSIS

(71) Applicant: ScoliWRx Inc., Campbell, CA (US)

(72) Inventor: Matthew I Janzen, Campbell, CA (US)

(73) Assignee: ScoliWRx, Inc., Campbell, CA (US)

( * ) Notice: Subject to any disclaimer, the term of this patent is extended or adjusted under 35 U.S.C. 154(b) by 271 days.

(21) Appl. No.: 15/342,828

(22) Filed: Nov. 3, 2016

Related U.S. Application Data

(60) Provisional application No. 62/250,614, filed on Nov. 4, 2015.

(51) Int. Cl.
*A61H 1/02* (2006.01)
*A63B 23/02* (2006.01)
*A63B 23/00* (2006.01)

(52) U.S. Cl.
CPC ..... *A61H 1/0292* (2013.01); *A63B 23/0238* (2013.01); *A63B 2023/006* (2013.01); *A63B 2208/0238* (2013.01); *A63B 2225/09* (2013.01)

(58) Field of Classification Search
CPC ..... A63B 2225/09
See application file for complete search history.

(56) References Cited

U.S. PATENT DOCUMENTS 2,102,069 A * 12/1937 Hanicke ..... A61F 5/055 128/DIG. 23
2,791,999 A * 5/1957 Bustamante ..... A61F 5/055 128/DIG. 23
3,170,659 A * 2/1965 Wood, Jr. ..... B64D 25/06 244/122 B
3,596,655 A * 8/1971 Corcoran ..... A61H 1/008 297/391
4,494,533 A 1/1985 Nunzio
5,042,799 A * 8/1991 Stanley ..... A63B 21/0004 482/112
5,192,305 A 3/1993 Sastre
5,423,333 A * 6/1995 Jensen ..... A61F 5/3753 128/878
6,113,562 A * 9/2000 Bonutti ..... A61F 5/013 602/16
7,402,145 B1 7/2008 Woggon et al.
7,547,289 B2 * 6/2009 Branch ..... A61H 1/0281 601/26
7,717,834 B2 * 5/2010 Kay ..... A61H 1/0281 482/124
7,766,850 B2 8/2010 Simanovsky
(Continued)

OTHER PUBLICATIONS

"Mobilisation of neural structures opens up new possibilities for idiopathic scoliosis treatment", E Santos Leal From 8th International Conference on Conservative Management of Spinal Deformities and SOSORT 2011 Annual Meeting: Barcelona, Spain. May 19-21, 2011 Scoliosis2012, 7(Suppl 1) Published: Jan. 27, 2012.

*Primary Examiner* — Garrett K Atkinson
(74) *Attorney, Agent, or Firm* — Penilla IP, APC

(57) ABSTRACT

The progress of what has previously been considered idiopathic scoliosis it is arrested and corrected by exercises that gradually stretch the spinal cord to catch and keep up with bone growth. An inventive frame enables such exercises by precluding the movement of the spinal column that is a result of the shorter spinal cord.

22 Claims, 10 Drawing Sheets

(56) References Cited

U.S. PATENT DOCUMENTS

| | | | | |
|---|---|---|---|---|
| 7,811,243 | B1 | 10/2010 | Kollmann | |
| 8,273,038 | B1 | 9/2012 | Woggon et al. | |
| 8,323,223 | B1 | 12/2012 | Woggon et al. | |
| 8,591,441 | B2 * | 11/2013 | Bonutti | A61F 5/013 602/16 |
| 9,199,114 | B1 * | 12/2015 | Santoro | A63B 21/015 |
| 9,226,867 | B2 * | 1/2016 | Threlfall | A61H 3/02 |
| 9,855,181 | B2 * | 1/2018 | Caires | A61H 1/024 |
| 2003/0130600 | A1 * | 7/2003 | Branch | A61H 1/0281 601/5 |
| 2008/0262402 | A1 | 10/2008 | Ogilvie | |
| 2009/0137934 | A1 | 5/2009 | Seon | |
| 2010/0010396 | A1 * | 1/2010 | Branch | A61H 1/0281 601/5 |
| 2018/0168910 | A1 * | 6/2018 | Threlfall | A61H 3/008 |

* cited by examiner 330
211
301

100
201
302
114'
214
E
D
212
201
211
211
212
302
216
216
301
122
215
110
115a
115a
122
115
115b
115
215
112
111
111

114

E
D
215
122
211
216
114
212

100
501
131/130

E
D
212
211
131
131
216
V
130
215
115a
110
130
505

506
122
115
115b
130
112

130
E
D

SPINAL CORD AND MENINGES STRETCHING FRAME AND METHOD TO PREVENT AND TREAT THE ROOT CAUSE OF SCOLIOSIS

CROSS REFERENCE TO RELATED APPLICATIONS

The present application claims the benefit of priority to the US Provisional Patent application of the same title, which was filed on 4 Nov. 2015, having application Ser. No. 62/250,614, which is incorporated herein by reference.

BACKGROUND OF INVENTION

The field of inventions is devices and exercise methods that deploy such devices to prevent and correct spinal deformities, in particular spinal scoliosis.

Braces and Schroth exercise routines are the standard conservative intervention in scoliosis. Braces, as well as the German-developed Schroth exercises have been used separately and together to correct various types of curvatures of the spinal, known as scoliosis. Some conditions cannot be fully corrected with these methods, and if they progress may necessitate spinal surgery procedures, including fusion and/or the implantation of medical devices to internally support the spine in a correct position. Hence, it is desirable to provide such corrective methods to patients to avoid future surgical intervention which poses risks, expense and at least temporary absence of the patient from work and/or school.

Further, some types of scoliosis are resistant to correction with prior Schroth exercises and braces, and only partial correction can be achieved.

In particular, as scoliosis is more difficult to correct once it progresses, it is most desirable to diagnosis scoliosis at the earliest stage possible and prevent further progress.

Accordingly, there is a need for improved non-surgical care, braces and exercise routines that more effectively prevent and arrest progressive scoliosis as well as treat scoliosis. It should be noted that none of the prior art methods attempt to treat the tightness of the spinal cord as the root cause of the scoliosis.

It is a first object of the invention to provide a method that addresses the root cause of scoliosis, thus preventing development of scoliosis by arresting its progression, and for young or adolescent patients that are still growing, permits more complete treatment of the initial scoliosis as the patient grows.

It is another object of the invention to provide an apparatus for implementing such a method of treatment of the root driving force that makes the spine bend and twist into scoliosis.

The above and other objects, effects, features, and advantages of the present invention will become more apparent from the following description of the embodiments thereof taken in conjunction with the accompanying drawings

SUMMARY OF INVENTION

In the present invention, the first object is achieved by providing an exercise device for spinal cord and meninges stretching comprising an support frame having a posterior member, an anterior member opposing the posterior member, and at least one lateral side connecting and spacing apart the posterior and anterior members, a shoulder stability bar pad supported by the anterior frame member, a rib bumper pad disposed on an oblique portion of the frame that spans the anterior and posterior members, being disposed at an oblique angle of less than 90 degrees as measured form the angle formed with the portion of the anterior frame supporting the shoulder stability bar pad, an anterior thoracic pad supported by the anterior frame member, a posterior dorsal-upper dorsal (DUD)/upper thoracic pad supported by the posterior frame member.

A second aspect of the invention is characterized by a process of therapeutic exercise, the process comprising the steps of providing an apparatus having a support frame for disposing about a patient a shoulder stability bar pad, a rib bumper pad, an anterior thoracic pad, a posterior dorsal-upper dorsal (DUD)/upper thoracic pad, fitting the patient with the apparatus, seating the patient on the ground with legs extended and feet against one of a wall and a support, flexing the patient's chin to the patient's chest, curling up the patient into flexion to move the forehead toward an upper margin of the knee cap.

Another aspect of the invention is characterized by such a process of therapeutic exercise wherein said step of fitting comprises adjusting the shoulder stability bar pad to contact one of the coracoid process, the proximal humerus, and anterior upper ribs on the side of the primary thoracic or thoraco-lumbar curve.

Another aspect of the invention is characterized by such an exercise device for spinal cord and meninges stretching wherein the support frame has one or more sliding portions that are operative to adjust the distance of the rib bumper pad from a lateral side of the support frame.

Another aspect of the invention is characterized by any such exercise device for spinal cord and meninges stretching further comprising a primary thoracic pad that is coupled to the posterior frame portion to translate along a primary axis thereof.

Another aspect of the invention is characterized by any such exercise device for spinal cord and meninges stretching wherein a lateral side frame that is opposite the rib bumper pad is at least partially surrounded by an axilla pad member.

Another aspect of the invention is characterized by any such exercise device for spinal cord and meninges stretching wherein at least one of the pads is in hinged engagement with the support frame.

Another aspect of the invention is characterized by any such exercise device for spinal cord and meninges stretching wherein the posterior DUD/upper thoracic pad is supported by an upward armature in hinged connection with the posterior frame member.

Another aspect of the invention is characterized by any such exercise device for spinal cord and meninges stretching wherein the posterior DUD/upper thoracic pad has a pivoting coupling on the support armature that is coupled to the posterior frame member to provide two independent rotation axis of hinged engagement.

Another aspect of the invention is characterized by any such exercise device for spinal cord and meninges stretching further comprising one or more straps coupling the anterior member of the support frame to the posterior member of the support frame.

Another aspect of the invention is characterized by any such exercise device for spinal cord and meninges stretching wherein the shoulder stability bar pad and the rib bumper pad are supported on the support frame to co-translate to fit the frame to the anatomy of the patient.

The exercise device for spinal cord and meninges stretching of claim 1 that further comprises a plurality of straps than span from opposing anterior and posterior sides of the frame.

Another aspect of the invention is characterized by any such exercise device for spinal cord and meninges stretching further comprising a primary thoracic pad disposed on the posterior frame portion between the posterior DUD/upper thoracic pad and the junction on the oblique portion of the frame with the posterior frame portion.

Another aspect of the invention is characterized by an exercise device for spinal stretching comprising a support frame fitted to a patient for supporting a plurality of pads to provide reactive forces during spinal stretching exercise, the pads comprising a shoulder stability bar pad supported by a portion of the support frame, a posterior thoracic pad supported by a portion of the support frame, a primary thoracic pad supported by a portion of the support frame, a posterior dorsal upper-dorsal (DUD)/upper thoracic pad supported by a portion of the support frame.

Another aspect of the invention is characterized by an exercise device for spinal stretching wherein one or more of the pads is supported on a substrate that has at least a portion curved to conform to one of a 2 and 3-dimensional body contour and the substrate is coupled to the frame.

Another aspect of the invention is characterized by any such exercise device for spinal stretching wherein the support frame is adapted to adjust position to accommodate the size and physique of the patient.

Another aspect of the invention is characterized by any such exercise device for spinal stretching wherein the support frame is shaped having one or more portions that are one of linear, curvilinear or curved.

Another aspect of the invention is characterized by any such exercise device for spinal stretching further comprising a means for placement of the frame on a patient to urge the one of more pads to a position on a patient to restrain spinal collapse when the patient is bending forward to stretch the spinal cord.

Another aspect of the invention is characterized by any such exercise device for spinal stretching wherein at least one of the pads is in hinged engagement with the support frame.

Another aspect of the invention is characterized by any such exercise device for spinal stretching wherein the support frame is close fitting.

Another aspect of the invention is characterized by any such exercise device for spinal stretching wherein the posterior DUD/upper thoracic pad has a pivoting coupling on a support armature that is coupled to the support frame to provide two independent rotation axes.

Another aspect of the invention is characterized by any such exercise device for spinal stretching further comprising one or more straps coupled to the opposing portions of the support frame.

The above and other objects, effects, features, and advantages of the present invention will become more apparent from the following description of the embodiments thereof taken in conjunction with the accompanying drawings.

BRIEF DESCRIPTION OF DRAWINGS

FIG. 3 A is a top plan view of the frame of FIG. 1, whereas

FIG. 4A-4E correspond to the view in FIG. 3A-E, but includes the preferred locations for supporting straps in which FIG. 4A is a top plan view of the frame of FIG. 1, whereas FIGS. 4B and 4C are right and left side view thereof. FIG. 4D and FIG. 4E are inner elevation views of the front and back respectively corresponding to view reference lines in FIGS. 4A of D-D and E-E.

DETAILED DESCRIPTION

Figure 1A:
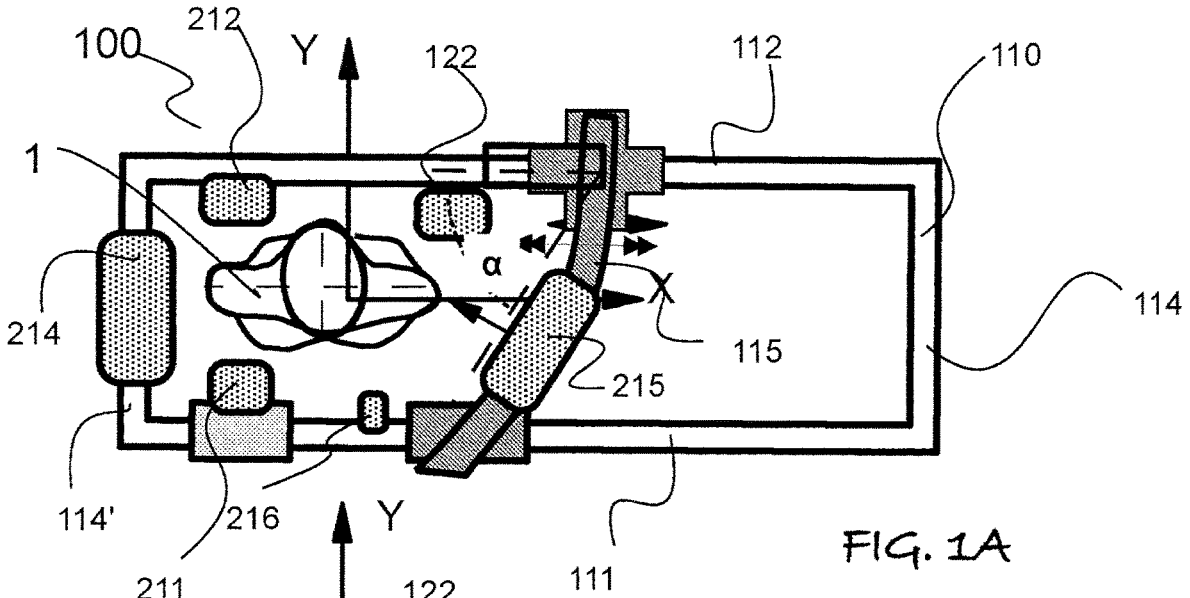
FIG. 1A is a schematic diagram of the frame and patient in a top plan view showing components of an embodiment of the frame to showing fitting to the patient, whereas FIG. 1B

Referring to FIGS. 1A through 10B, wherein like reference numerals refer to like components in the various views, there is illustrated therein a new and improved Stretching Frame and Method to Treat and Prevent the root cause of Scoliosis, in which the frame is generally denominated 100 herein.

It has been suggested that a tight spinal cord is associated with scoliosis. Scoliosis formerly referred to as idiopathic (as having an unknown cause), is more widely believed to now be caused by a failure of the spinal cord to grow with the remainder of the skeleton during adolescence. When the spinal cord growth is retarded with respect to vertebral and related skeletal growth, the spine must curve and rotate to accommodate the shorter spinal cord. It has been discovered that the spinal cord will stretch permanently to accommodate the increased length of the normal spinal column due to growth with repeated and specific exercises using a novel apparatus, referred to herein as the stretching frame 100. Such exercises limit the progression of scoliosis and are more effective in achieving reversal in combination with other forms of exercise and therapy, as they address the root cause of scoliosis.

In accordance with the present invention, the stretching frame 100 comprises a support frame 110 generally having a posterior member 111, an anterior member 112 opposing the posterior member 111, and one or more sides 114 connecting and spacing apart the posterior and anterior members 111 and 112. An anterior thoracic pad 212 is supported by the anterior frame member 112.

A shoulder stability bar pad 122 is also preferably supported by the anterior frame member 112. A rib bumper pad 215 is disposed on a portion 115 of the support frame 110 that spans the anterior 112 and posterior members 111, being disposed at an oblique angle of less than 90 degrees as measured from the angle, $\alpha$, formed with the portion of the anterior frame 112 supporting the shoulder stability bar pad 122. The support frame 110 is preferably disposed in suspension on the patient with straps 130 and 131. The support frame 110 is generally sized to the patient so that the shoulder stability bar pad 122 is typically contacting the coracoid process, the proximal humerus, or the anterior upper ribs (2-4) on the side of the primary thoracic or thoraco-lumbar curve. Depending on the support frame 110 shape and size with respect to the range of patient ages and sizes it is intended to accommodate, the various sub-portions of the frame and support pads may have greater ranges of adjustment to collectively engage the intended anatomical features of the patient.

Figures 3A, 3B, 3C, 3D, 3E:
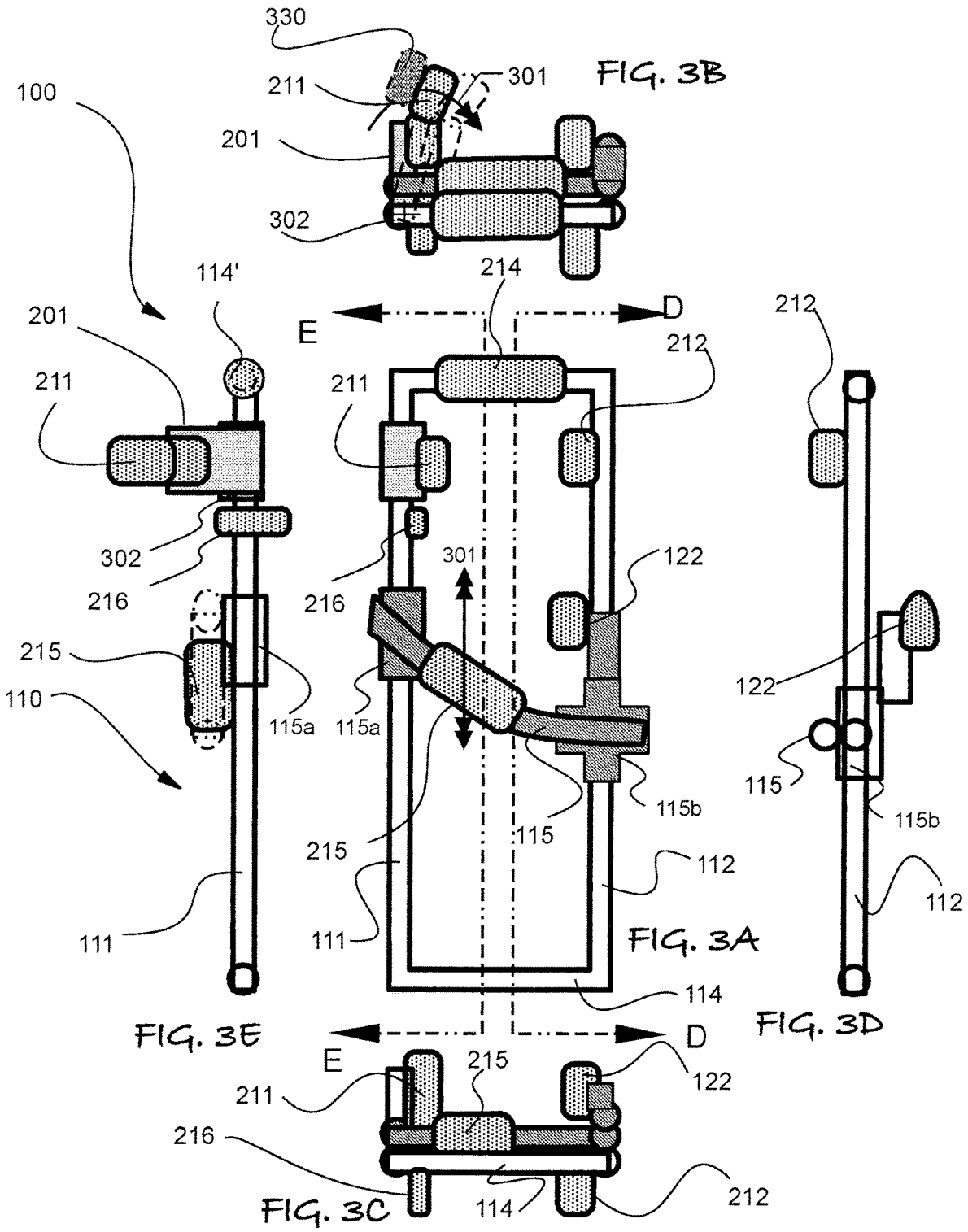
FIGS. 3B and 3C are respectively a right and left side view thereof.
FIG. 3D and FIG. 3E are inner elevation views of the front and back respectively corresponding to view reference lines in FIGS. 3A of D-D and E-E.

A primary thoracic pad 216 is optionally disposed on the posterior frame portion 111 between the posterior dorsal upper-dorsal (DUD)/upper thoracic pad 211 and the junction of the frame portion 115 with posterior frame portion 111. More preferably the primary thoracic pad 216 is attached to frame portion 115 so that this pad 216 slides in and out of place, and is more adjustable in height. The primary thoracic pad 216 is disposed to have portions that descend downward and upward from the support frame 110 as shown in FIG. 3E, while the posterior DUD/upper thoracic pad 211 extends in the opposing direction upward. The side frame 114' that is opposite the rib bumper pad 215 preferably is also padded with a surrounding axilla pad member 214. In clinical practice the primary thoracic pad 216 is more frequently disposed to extending upward from support frame 110, and typically by at least about 50% of the pad extends above the frame 111.

Figure 5:
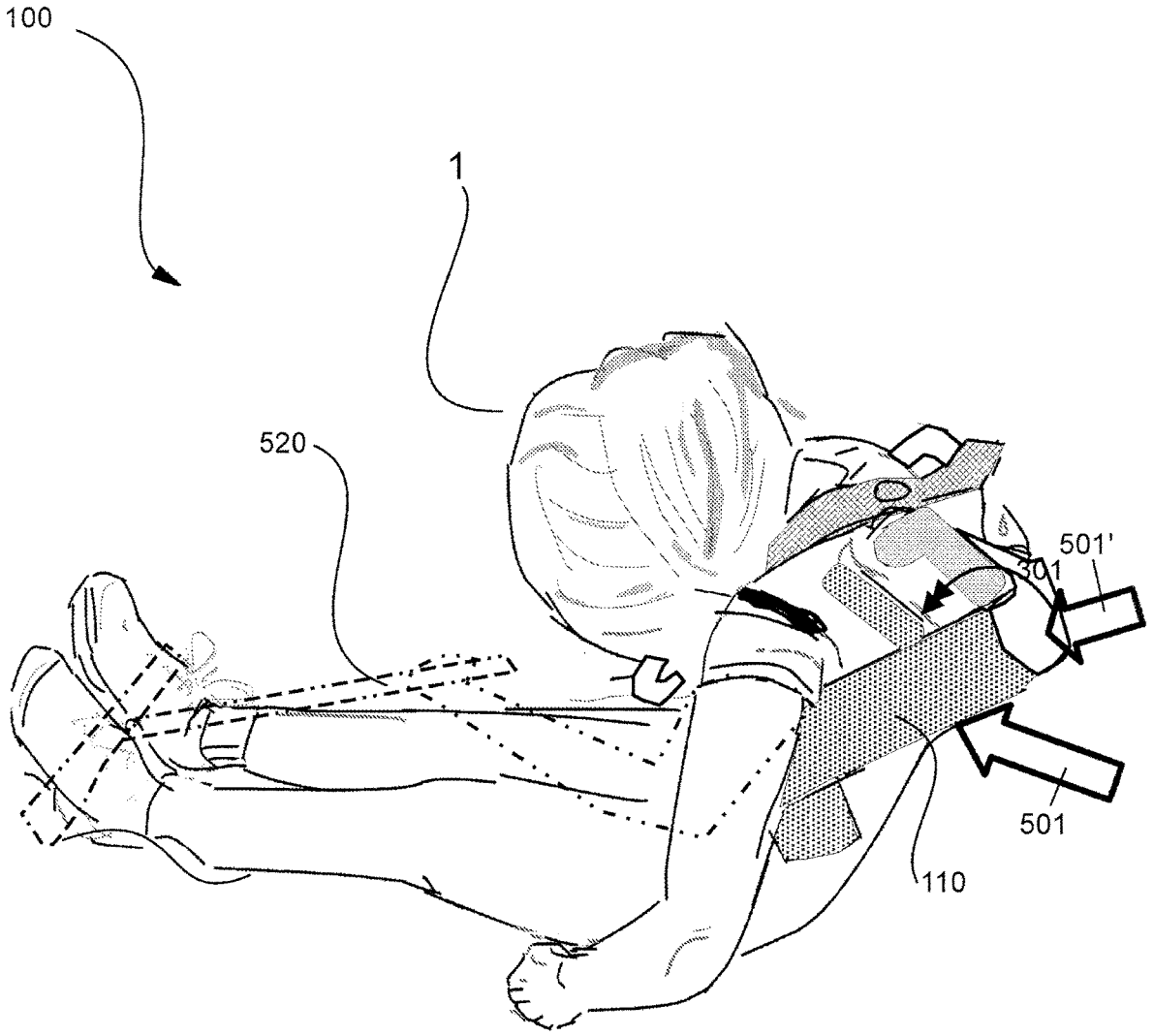
FIG. 5 illustrates in a side perspective view of the use and fitting of the frame as the patient is performing a stretching exercise.
Figure 6:
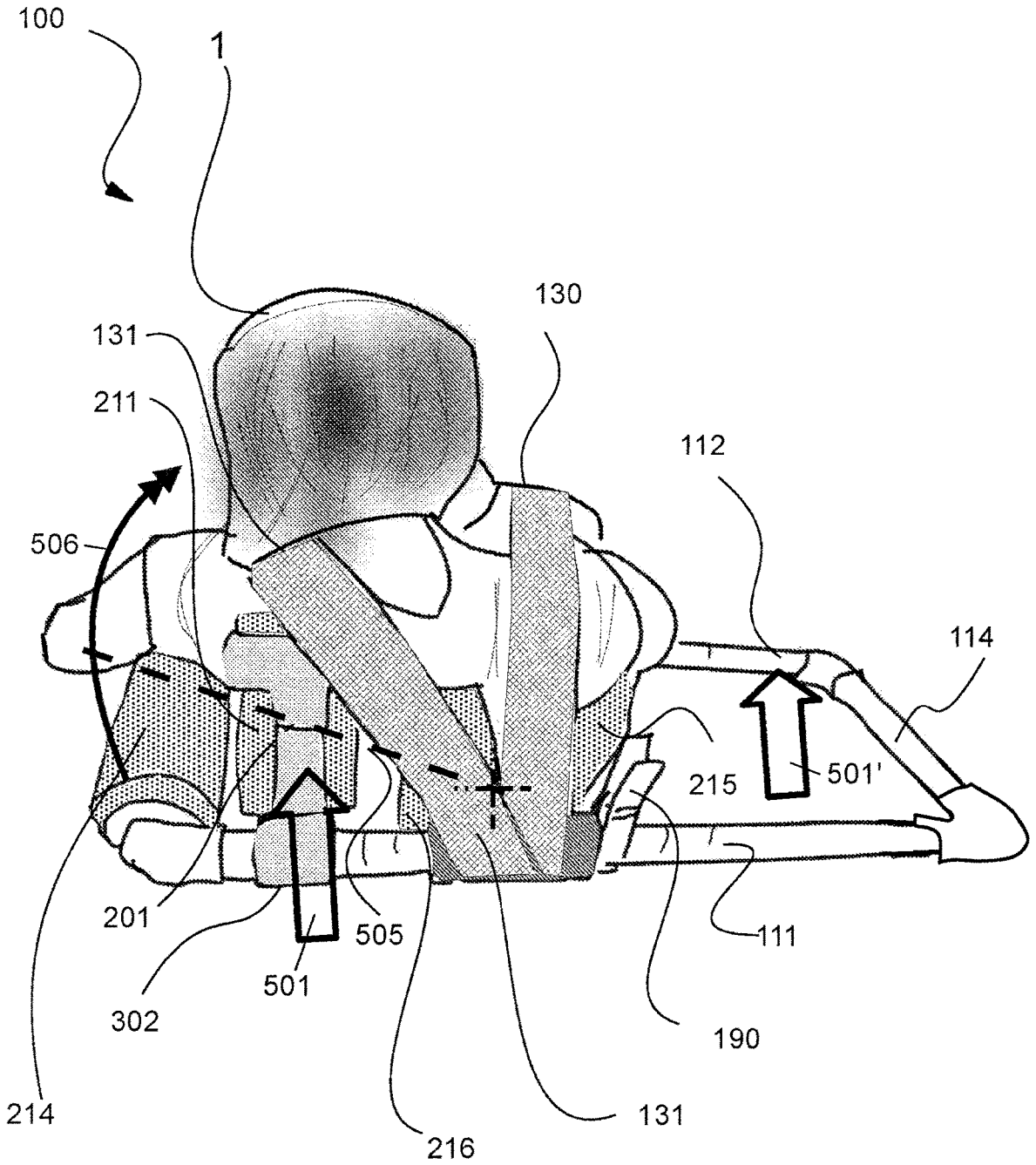
FIG. 6 is a rear perspective view of FIG. 5.
Figure 7:
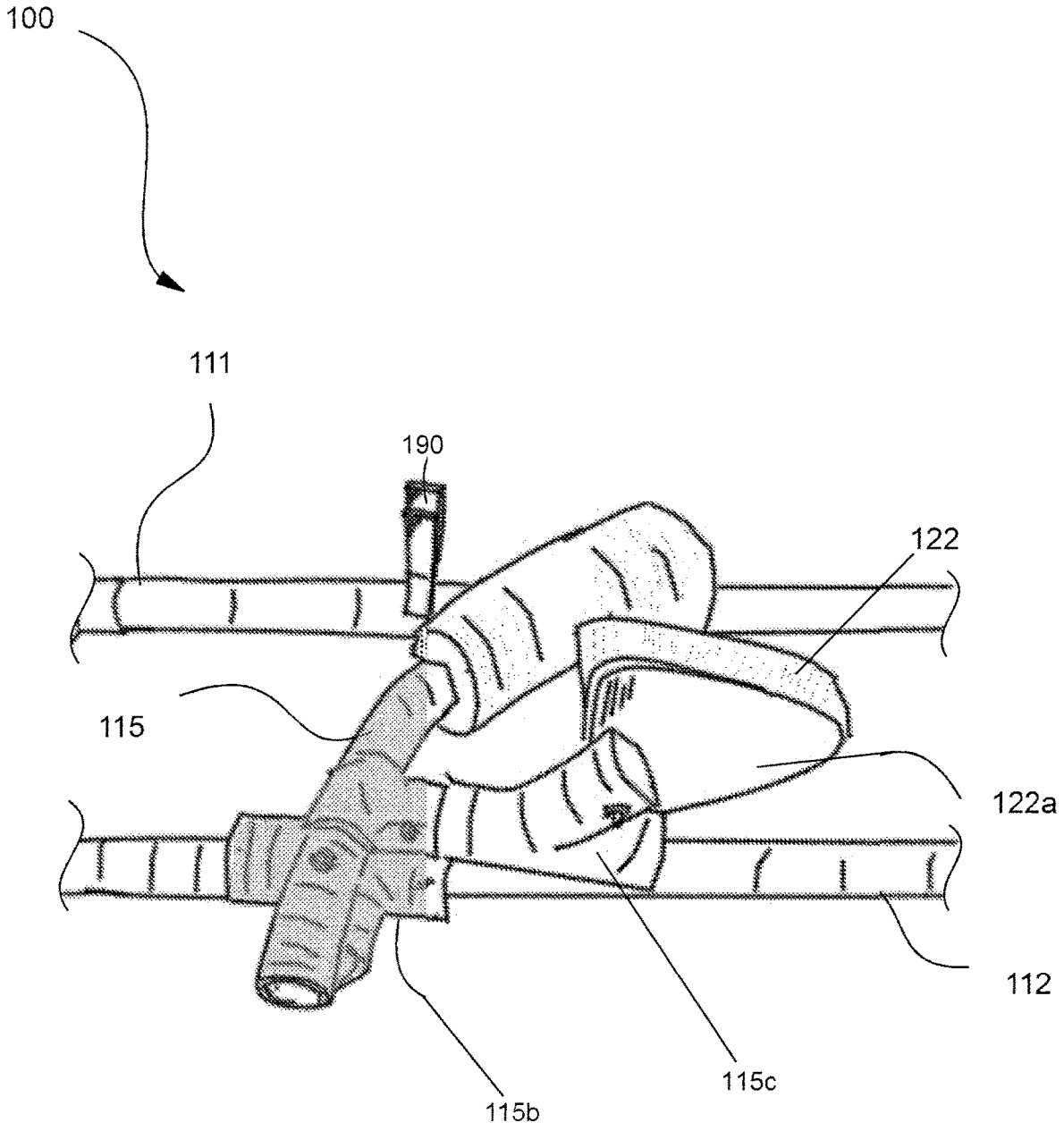
FIG. 7 is a front perspective view of a portion of the frame in FIG. 1-3.

When used in the inventive exercise method, the novel frame 100 de-rotates the spine from the scoliotic malformation so that as the spinal cord is stretched through forward bending as shown in FIGS. 5 and 6; the vertebra cannot continue to rotate further, causing the gradual elongation of the spinal cord from stretching. In the exercise routine, the frame 100 is primarily restraining and reducing scoliotic rotation, which is key to protect the scoliosis from worsening either during or without exercise. Absent the frame 100 as a restraint during exercise, the convexity of the spinal curves would increase as when the spine stretches. This would lead to a failure to adequately stretch the spinal cord and to possible increases in the size of the scoliotic deformity. The shoulder stability bar 122 stabilizes the device 100 by contacting the coracoid of the scapula, the anterior upper ribs, or the upper humerous (anterior deltoid). As shown in FIG. 3D and FIG. 7, the shoulder stability bar 122 attaches to the front of union 115*b* that supports the sliding rib bumper 215 on the frame segment 115 at the anterior frame segment 112. The "DUD pad" or "upper thoracic pad" 211 contacts and de-rotates the dorsal-upper dorsal (DUD or Upper Thoracic) curve of the patient. The Anterior Thoracic Pad 212 provides stabilization for device 100 as well as a forced de-rotation of the primary thoracic curve (correction in the axial plane). The rib bumper pad 215 contacts the primary thoracic rib hump for correction in coronal plane (Cobb angle correction) as well as de-rotation (correction in axial plane). The Primary thoracic pad 216 contacts the primary thoracic curve, and primarily provides de-rotational force of primary curve rotation (where the rib hump is), with correction in the axial plane. The Axilla pad 214 locks the device in, as well as provides lift of the primary thoracic curve when the opposite end of the device is cantilevered downward. This provides passive correction in the coronal plane, resulting in a Cobb angle correction. The sum-total of all these corrective forces, when combines with flexion of the spine, elongates the spinal canal and provides a therapeutic stretch to the tight spinal cord and meninges.

Figure 1B:
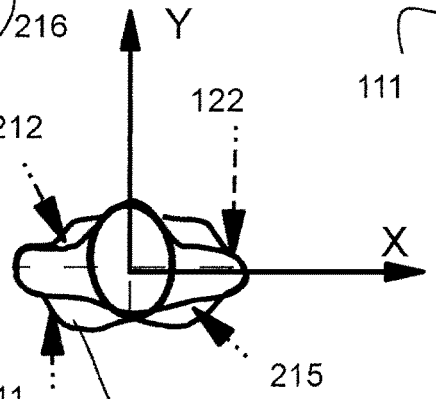
-FIG. 1D illustrates the patient in different views to illustrate how components of the frame apply reactive corrective force during the stretching exercise of FIG. 5.
Figure 1C:
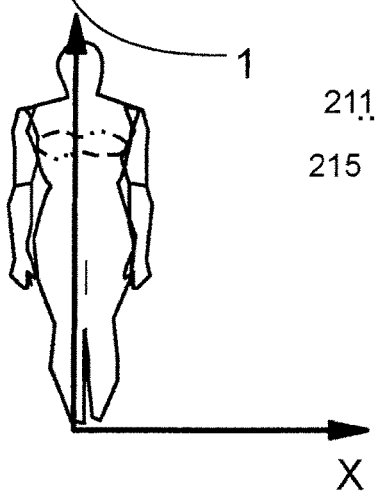
Figure 1D:
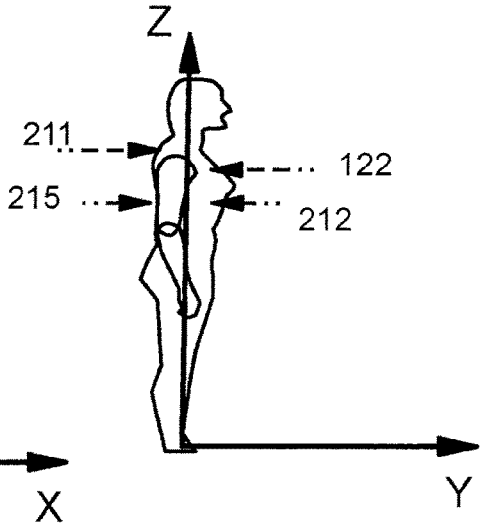
Figure 2:
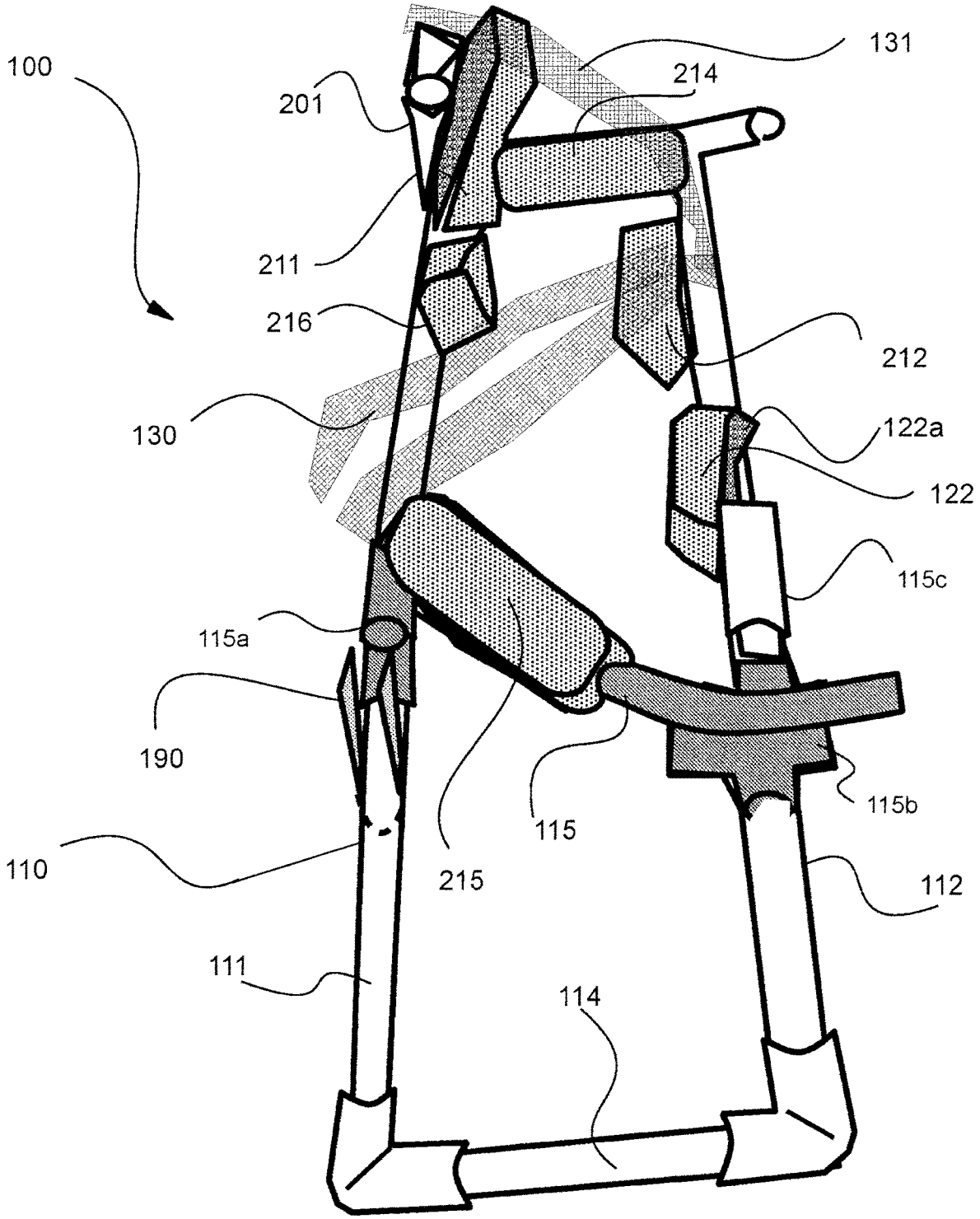
FIG. 2 is a side perspective view of the frame of FIG. 1.

It is important to recognize the above description of the frame components is merely illustrative, as equivalent functions can be achieved with alternative frame of brace like structure so long as they have sufficient padded portions to provide the reactive forces in the anatomically correct location as shown in FIG. 1B-D when the patient bends forward as shown in FIG. 5. Such functionally equivalent frames can have less or more than the 4 sides described above and different portions may adjust position to accommodate the size and physique of the patient. The frame or frame sides can be linear, curvilinear or curved, and in the sense of a circle, ellipse or ring that does not have discrete sides. Further, the frame can be the mirror image of the device in FIG. 1A, depending of the direction of spinal curvatures. The support frame 110 can also be similar to a body cast like device, provided the upper and lower dorsal portions with equivalent pads that are hinged or otherwise flexes to allow the forward bending by the patent as shown in FIG. 5. In a body cast or a close fitting configuration, it may be possible to eliminate all or some of the straps that position the frame and corrective padding vertically on the patient. The term close fitting is intended to embrace the following of a portion of the patient's skin or skeletal contours as in 2 or 3 dimensions. Such close fitting is optionally achieved by one or more of the pads being supported on substrate that has at least a portion curved to conform to one of a 2 and 3-dimensional body contour and the substrate is coupled to the frame. It can also be achieved by grading the pliability of the pads, with a under pads being so contoured and a softer pad overlaying it for contacting the patient.

Another aspect of the invention includes such aspects with the support frame may comprise linkages that connect a plurality of such substrates, in which the frame need not form any particular geometric shape and need not be a discrete continuous member. In such a case, depending on the padding members used, strapping not be required to place the frame around the patient. Alternatively, strapping can be with elastic members that are at least partially orientated horizontally or vertically. The elastic members need not have a wide tape like shape if they contact the patient with a close fitting member or padding. It should be understood that close fitting configurations of a frame can be accomplished by various combinations of 2 and 3 dimension shapes elastically or adjustably coupled.

Various embodiment of the support frame 110 are optionally constructed with plastic or PVC resin pipe, using standard plumbing elbow joints at the orthogonal corner of the sides 114 and 114' with the poster and anterior member 111 and 112. However the support frame 110 is preferably custom fitted to each patient. The various pads, and more rigid pad backing the attaches to the frame, are also preferably customer shaped to each patent to provide maximum possible corrective forces.

It should be appreciated that when the support frame 110 is close fitting, the padding can be relatively thin and follow the interior frame contour. The support frame 110 can have a more relaxed or distal close fit when the internal padding is thicker and more compliant.

The sliding portion of the frame 115 with the posterior thoracic pad 215 is supported at opposing ends by oversized three and four way pipe unions 115*a* and 115*b* that receive in their bore the pipes that form the posterior and anterior frame member 111 and 112 respectively. Various combinations of the elbow and oblique 3 way unions also allow the placement of the shoulder stability bar pad 122 above the frame anterior portion 112. Similarly, and oversized pipe that received the posterior frame portion 111 is used to create the rotary coupling 302 of the upward armature 201 that supports the upper thoracic pad 211. Portions of the frame 100 are also covered with padding that matches the circular cross section shape of the cylindrical frame components shown in FIG. 1A and FIG. 2-4, as for example the axilla pad 214.

The frame 100 can be used with other device and have additional padding elements to correct more complex types and degrees of spinal curvature and rotation.

Hence, the following description of the placement of padding on the frame components is relative to the rectangular support frame 110 of FIG. 1, in which a posterior DUD/upper thoracic pad 211 is supported by the posterior fame member 111. A plurality of straps 130 and 131 span from opposing anterior and posterior sides 112 and 111 of the support frame 110 that support the anterior thoracic pads 212, shoulder stability bar pad 122 and rib bumper pad 215. The posterior DUD/upper thoracic pad 211 is also supported by an upward armature 201 in hinged connection 302 to the frame 112 to move forward in the direction of arrow 301 in FIG. 3. FIG. 7 illustrates a preferred embodiment in which the shoulder stability bar pad 122 is mounted on the generally rigid and planar pad support member 122*a* having an ovate shaped matching the shoulder stability bar pad 122 shape. The planar pad support member 122*a* is attached to the 45 degree segment of a 3-way pipe union 115*c* which is disposed on top of the 4 way pipe union 115*b* that slides over the anterior fame member 112, thus placing it above the rib bumper pad 215. Hence, the shoulder stability bar pad 122 and the rib bumper pad 215 co-translate as they are fitting to the patient's 1 anatomy prior to stretching exercises.

The straps 130 and 131 support the support frame 110 at the appropriate height on the patient q to position the pads as shown in FIGS. 1B and 1D, and are preferably of adjustable length to facilitate placement and removal from the patient 1 and readjustment as the patient 1 grows. At least one of the straps 130 and 131 preferably extend over the patient 1 in an opposing oblique direction with respect to the other straps, with the straps spanning the anterior and posterior frame portions 112 and 111. More preferably, each of the straps 130 and 131 extends over the opposing shoulder from the other strap and has a buckle disposed in front of the patient, which is adapted for adjusting the strap length. For example, in the preferred embodiment of FIG. 6, the strap 131 extends from circa the connector 115*a* and posterior DUD/upper thoracic pad 211 to the anterior frame 112, supporting the support frame 110 on the right shoulder (in a frontal view), while the other strap 130 extends from the about the same position at the posterior frame 111 but over the left shoulder.

The frame 100 provides a means for placement of the above pads to restrain spinal collapse, which is essentially the continuity of the same type of spinal curvature presenting in the patient, which would otherwise occur upon bending forward to stretch the spinal cord.

Figures 4A, 4B, 4C, 4D, 4E:
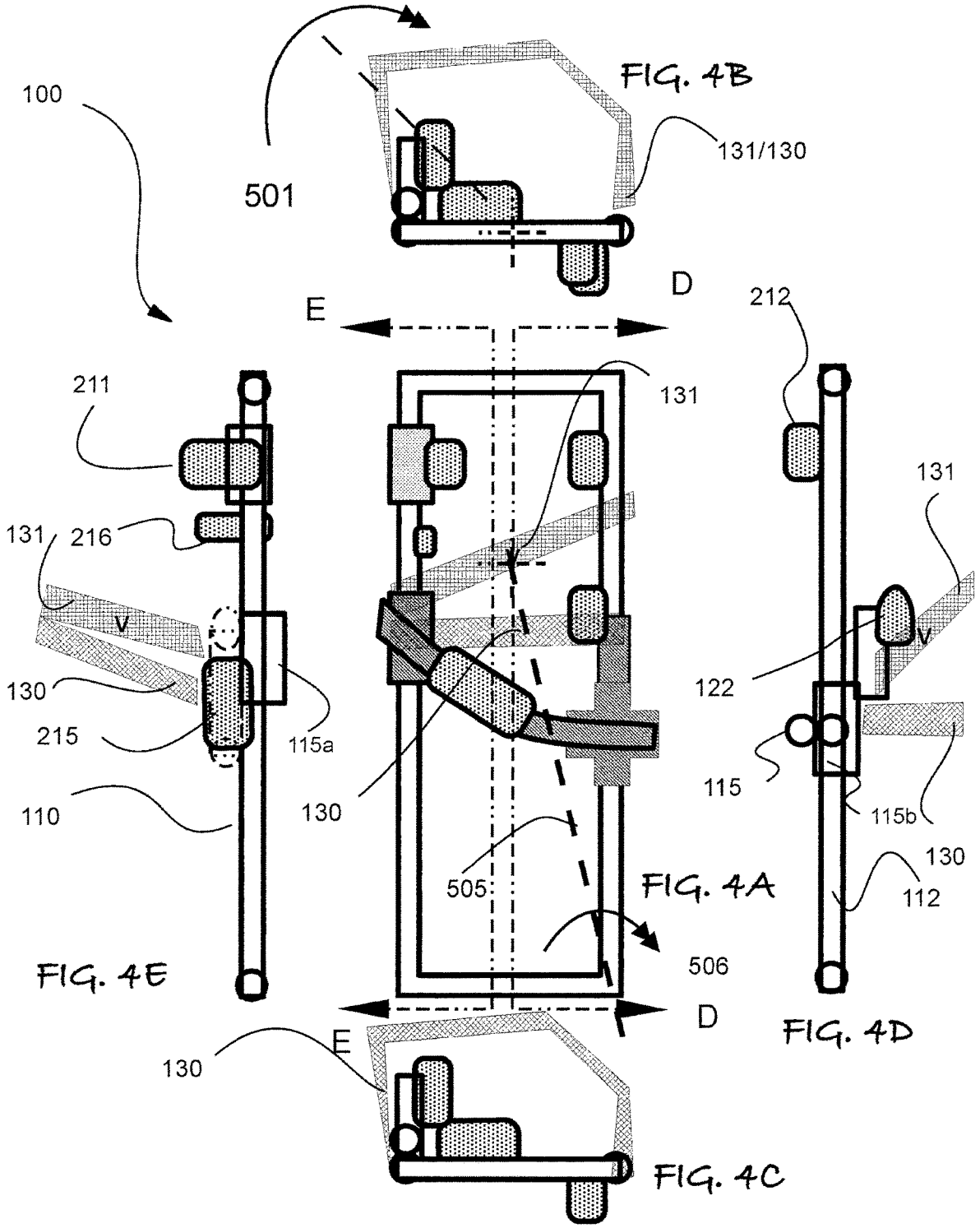

The methods of spinal exercise is generally illustrated in FIGS. 5 and 6 in which the subject leans forward to stretch the spine, which is assisted with an assistant supporting and/or urging forward of the support frame 110 in the direction of the arrows 501 and 501' to rotate the frame about the reference axis 505 shown in FIG. 4A and FIG. 6, with the support frame 110 rotating in the direction of arrow 506. The legs are kept straight while the patient sits on the floor, with the feet preferably against a wall or vertical support member. The patient 1 bends forward at the waist pointing their head downward while an assistant applies gentle repeated cooperative force to the support frame 110 in the direction of the arrows 501 and 501', generally applying a combination of torque and forward motion to the support frame 110 that is also generally coincident with the patient natural movement.

It should be appreciated that the posterior DUD/upper thoracic pad 211 retains contact with the patient's 1 back as they lean forward due to the hinged connection 302 to the poster frame portion 111.

Alternatively, the subject can undergo solo stretching by using and pulling forward on the strap 520 shown in phantom lines in FIG. 5, if fixed to a bar or other member that is restrained with or at the feet. The posterior DUD/upper thoracic pad 211 is also weighted with weight 330 to urge its forward rotation as would occurs with the helper pushing on it at arrow 501' above the hinge 302, as shown in FIGS. 5 and 6.

Typically, patients will spend 5-15 minutes, 2-3 times a day stretching the spinal cord with the stretching frame. During a 15 minute session, 1-2 minute stretch and holds are employed. The patient 1 is seated on the ground with the legs extended and feet flat against a wall or support. With the device 100 in place on the body, the patient flexes forward to lower their chin to the chest, and then curl up into flexion to attempt to move the forehead to the upper margin of the knee cap. The goal is for the patient to eventually be able to touch the forehead to the knees. The progress of each stretch is measured by how many cm or inches the patient is away from the knee cap (forehead to upper knee cap). While the patient is able to complete the full stretch, the exercise routine should be continued as they grow.

Figure 8:
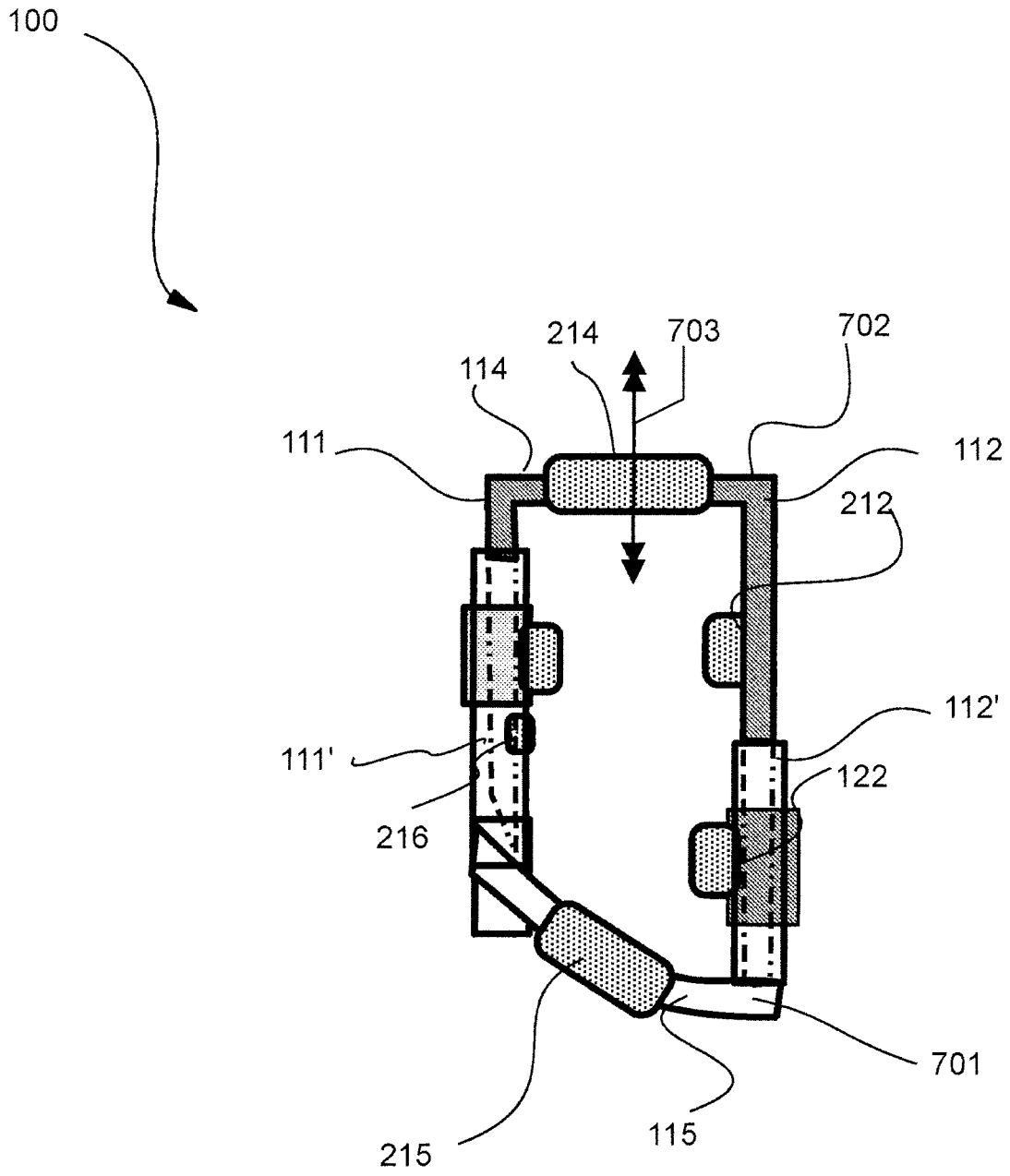
FIG. 8 is a top plan view of an alternative embodiment of the frame.

FIG. 8 illustrates an alternative embodiment of the frame 100 in which the support frame 110 for various pads has segments 701 and 702 which include sides 115 or 114. Segments 701 and 702 also include mutually telescoping posterior and anterior portion 112/112' and 111/111' between the side sides 115 and 114. The rib bumper pad 215 is fixed to side 115 of segment 701, which includes posterior and anterior frame portions 111' and 112'. Side 115 is at an oblique angle with respect to side 111' and 112'. The side 114 is on a U-shaped segment 702 with orthogonal sides 111 and 112 which are respectively received in the bores of the oversized pipes section 111' and 112', so that portions 701 and 702 can laterally displace in the direction of the arrow 703. Hence it is possible to fit the axilla pad 214 to the patient after the rib bumper pad 215 is fitted to the patient. The sliding segments 701 and 702 of the frame can kept in position with any number of external clamps, such as the pipe clamp 190 in FIG. 6, or with screws, bolts, pins and that like that optionally connect the telescoping pipe segments 111/111' and 112/112'.

Figure 9:
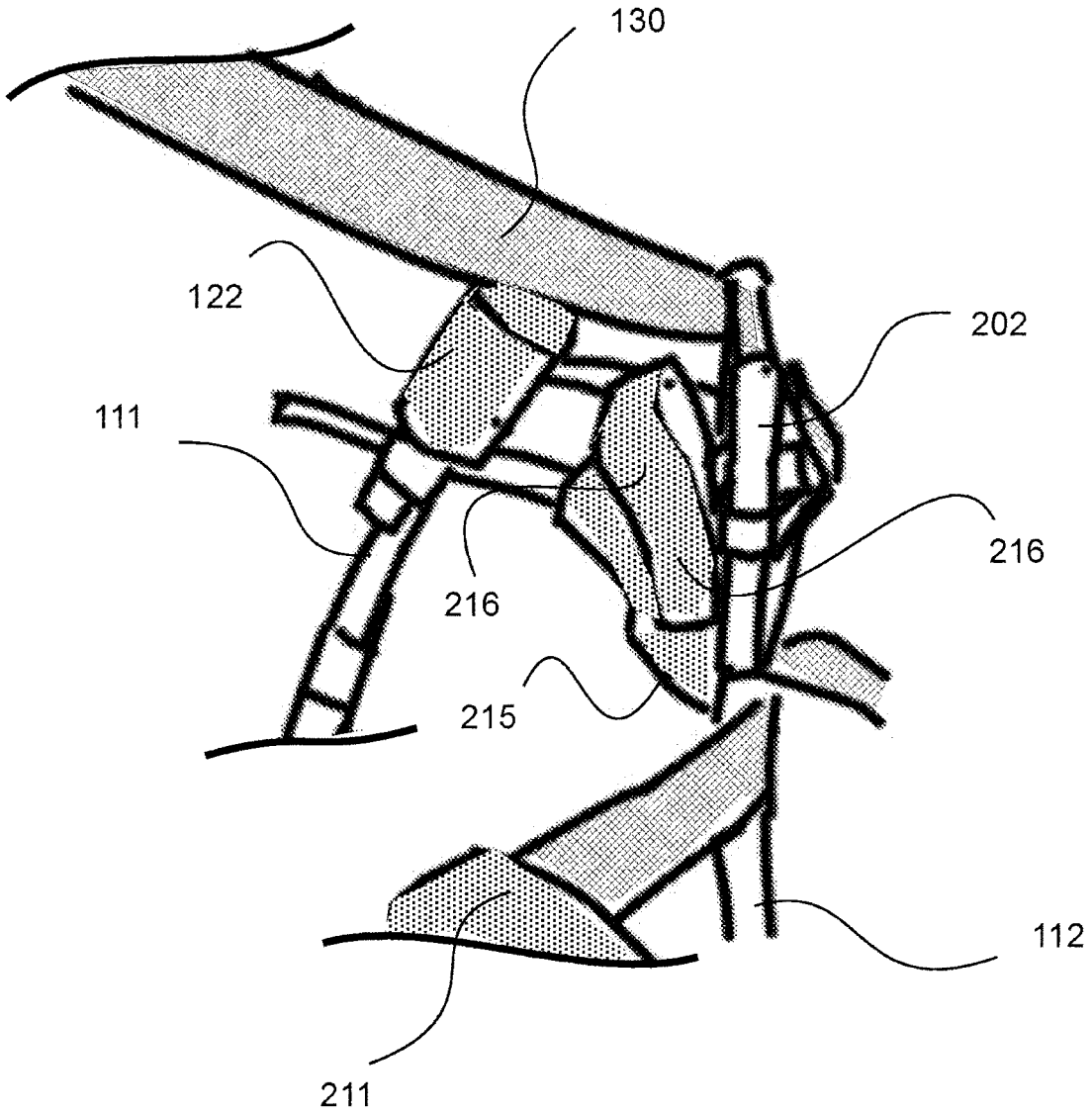
FIG. 9 is a side perspective view of an alternative embodiment of the frame.
Figure 10A:
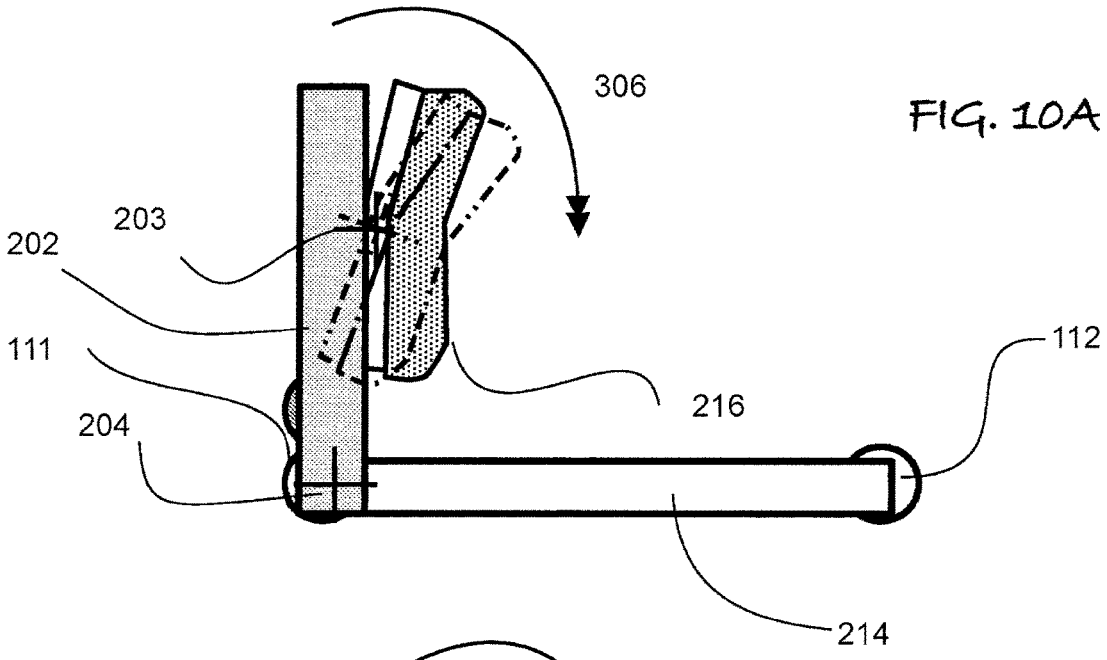
FIGS. 10A and 10B are schematic side elevations views to illustrate alternative positions of portions of the embodiment in FIG. 9.
Figure 10B:
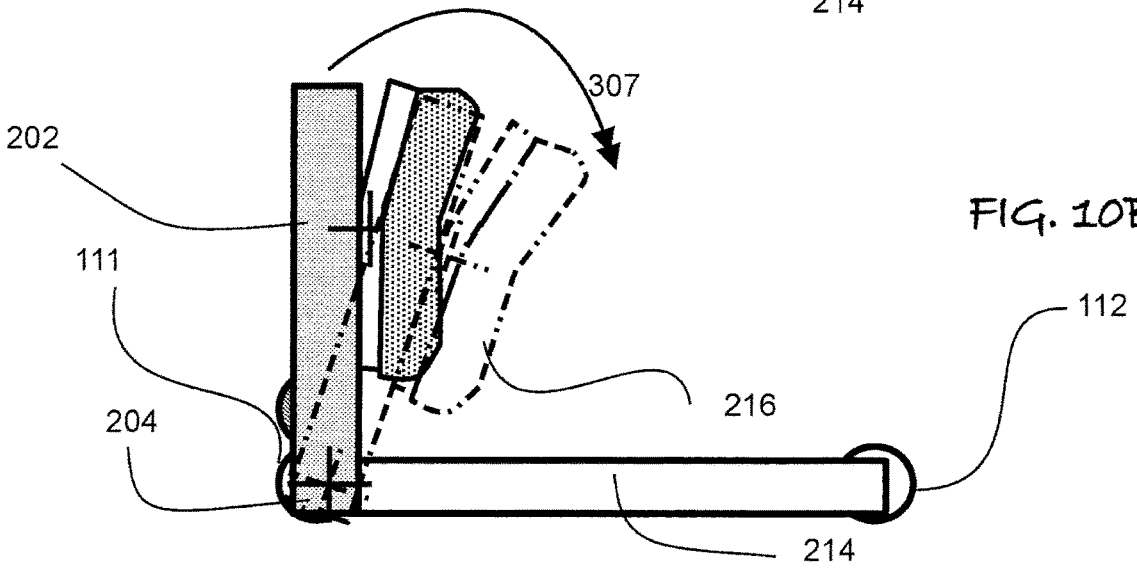

FIGS. 9, 10A and 10B illustrate a preferred support frame 110 and primary thoracic pad 216 which pivots on an upward armature 202 at axle 203, to more in the direction of arrow 306 (FIG. 10A). The upward armature 202 in turn pivots on the hinged connection 204 to the posterior frame portion 112 to move in the direction of arrow 307 (FIG. 10B). Thus in FIG. 10A the phantom outline of the primary thoracic pad 216 and upward armature 202 are both rotated clockwise. It should be understood that the rotation the pad 216 and the armature 202 can occur simultaneously and independently of the other to maintain thoracic contact during the stretching exercise.

Further, in a more preferred embodiment the posterior DUD/upper thoracic pad 211 has a pivoting coupling on the support armature 201 to provide two independent rotation axes for the pad as shown in FIGS. 10A and 10B for the primary thoracic pad 216.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. An exercise device for spinal cord and meninges stretching, comprising:

a support frame having a posterior frame member, an anterior frame member opposing the posterior frame member, and a lateral side frame member connecting and spacing apart the posterior and anterior frame members;

an oblique frame member having a first end connected to the anterior frame member and a second end connected to the posterior frame member;

a shoulder stability pad supported by the anterior frame member;

a rib bumper pad disposed on the oblique frame member, the rib bumper pad having a body contacting surface disposed at an angle of less than 90 degrees relative to an axis of the anterior frame member;

an anterior thoracic pad supported by the anterior frame member; and a posterior dorsal-upper dorsal (DUD)/upper thoracic pad supported by the posterior frame member.

2. The exercise device as recited in claim 1, wherein the first end of the oblique frame member is connected to the anterior frame member by a first sliding member, or the second end of the oblique frame member is connected to the posterior frame member by a second sliding member, or the first end of the oblique frame member is connected to the anterior frame member by the first sliding member and the second end of the oblique frame member is connected to the posterior frame member by the second sliding member, wherein each of the first and second sliding members is operative to adjust a distance of the rib bumper pad from the lateral side frame member.

3. The exercise device as recited in claim 2, further comprising:

a primary thoracic pad coupled to the posterior frame member in a configuration that is translatable along a primary axis of the posterior frame member.

4. The exercise device as recited in claim 1, further comprising:

an axilla pad disposed on the lateral side frame member.

5. The exercise device as recited in claim 1, wherein at least one of the shoulder stability pad, the posterior DUD/upper thoracic pad, and the anterior thoracic pad is in hinged engagement with the support frame.

6. The exercise device as recited in claim 5, wherein the posterior DUD/upper thoracic pad is supported by a support armature in hinged connection with the posterior frame member.

7. The exercise device as recited in claim 6, wherein the posterior DUD/upper thoracic pad is pivotally coupled to the support armature.

8. The exercise device as recited in claim 1, further comprising:

one or more straps extending from the anterior frame member to the posterior frame member, each of the one or more straps configured to extend over a shoulder of a person when the person is present in the support frame at a location between the anterior frame member, the posterior frame member, the lateral side frame member, and the oblique frame member.

9. The exercise device as recited in claim 1, wherein the shoulder stability pad and the rib bumper pad are translatable relative to each other.

10. The exercise device as recited in claim 1, further comprising:

a plurality of straps that span between the anterior frame member and the posterior frame member.

11. The exercise device as recited in claim 1, further comprising:

a primary thoracic pad disposed on the posterior frame member between the posterior DUD/upper thoracic pad and the second end of the oblique frame member.

12. An exercise device for spinal stretching, comprising:

a support frame configured to support a plurality of pads to provide reactive forces to a person during performance of a spinal stretching exercise on the person with the person positioned inside of the support frame, the plurality of pads including a shoulder stability pad positioned to contact an anterior portion of the person on a first lateral half of the person when the person is positioned inside of the support frame, a rib bumper pad positioned to contact a posterior-lateral thoracic portion of the person on the first lateral half of the person when the person is positioned inside of the support frame, a primary thoracic pad positioned to contact a posterior portion of the person when the person is positioned inside of the support frame, and a posterior dorsal upper-dorsal (DUD)/upper thoracic pad positioned to contact a posterior upper thoracic portion of the person on a second lateral half of the person when the person is positioned inside of the support frame.

13. The exercise device as recited in claim 12, wherein one or more of the shoulder stability pad, the rib bumper pad, the primary thoracic pad, and the posterior DUD/upper thoracic pad is supported on a substrate that has at least a portion curved to conform to a body contour of the person, wherein the substrate is coupled to the support frame.

14. The exercise device as recited in claim 13, wherein the support frame is sized and configured to provide for simultaneous contact of each of the shoulder stability pad, the rib bumper pad, the primary thoracic pad, and the posterior DUD/upper thoracic pad with the person.

15. The exercise device as recited in claim 12, wherein a size of the support frame is configurable to accommodate a size and physique of the person.

16. The exercise device as recited in claim 12, wherein the support frame includes a plurality of frame members, the plurality of frame members including at least one linear-shaped frame member and at least one curve-shaped frame member.

17. The exercise device as recited in claim 12, wherein at least one of the shoulder stability pad, the rib bumper pad, the primary thoracic pad, and the posterior DUD/upper thoracic pad is in hinged engagement with the support frame.

18. The exercise device as recited in claim 12, wherein the posterior DUD/upper thoracic pad has a pivoting coupling on a support armature that is coupled to the support frame.

19. The exercise device as recited in claim 12, further comprising:

one or more straps coupled to opposing portions of the support frame, each of the one or more straps configured to extend over a shoulder of the person when the person is present in the support frame.

20. A process of therapeutic exercise, comprising:

having an exercise device including a support frame configured to support a plurality of pads to provide reactive forces to a person during performance of a spinal stretching exercise on the person with the person positioned inside of the support frame, the plurality of pads including a shoulder stability pad, a rib bumper pad, an anterior thoracic pad, and a posterior dorsal-upper dorsal (DUD)/upper thoracic pad;

fitting the person within the support frame so that the shoulder stability pad is positioned to contact an anterior portion of the person on a first lateral half of the person, and so that the rib bumper pad is positioned to contact a posterior-lateral thoracic portion of the person on the first lateral half of the person, and so that the anterior thoracic pad is positioned to contact an anterior thoracic portion of the person, and so that the posterior DUD/upper thoracic pad is positioned to contact a posterior upper thoracic portion of the person on a second lateral half of the person;

seating the person on a ground surface with legs of the person extended and feet of the person against either a wall or a support structure;

flexing a chin of the person toward a chest of the person; and curling up the person into flexion to move a forehead of the person toward an upper margin of a knee cap of the person.

21. The process as recited in claim 20, wherein fitting the person within the support frame includes adjusting the shoulder stability pad to contact one of the coracoid process, the proximal humerus, and anterior upper ribs on a side of the person that has a primary thoracic or thoraco-lumbar scoliotic curve.

22. The process as recited in claim 20, wherein the plurality of pads includes a primary thoracic pad, and wherein fitting the person within the support frame includes positioning the primary thoracic pad to contact a posterior portion of the person.

* * * * *